US005197659A

United States Patent [19]

Vassiliou

[11] Patent Number: 5,197,659

[45] Date of Patent: Mar. 30, 1993

[54] DISPOSABLE BOX BY FOLDING INTO A LOG-SHAPED CONFIGURATION

[75] Inventor: Eustathios Vassiliou, Newark, Del.

[73] Assignee: WTPA, Incorporated, Newark, Del.

[21] Appl. No.: 917,159

[22] Filed: Jul. 21, 1992

[51] Int. Cl.[5] ..... B65D 5/36; B65D 5/42

[52] U.S. Cl. ..... 229/117.01; 229/117.05; 229/906; 229/DIG. 4

[58] Field of Search ..... 229/117.01, 117.05, 229/117.06, 902, 903, 906, 917, DIG. 2, DIG. 4; 426/113-115

[56] References Cited

U.S. PATENT DOCUMENTS

| | | | |
|---|---|---|---|
| 664,835 | 1/1901 | Czarniecki | 229/117.01 |
| 2,037,675 | 4/1936 | Boothby et al. | 229/117.01 |
| 2,189,436 | 7/1938 | Rosenfield | 229/4.5 |
| 2,244,940 | 6/1941 | Carruth | 229/5.5 |
| 2,671,593 | 3/1954 | Page | 229/5.7 |
| 2,807,405 | 9/1957 | Lambert | 229/41 |
| 2,845,976 | 8/1958 | Miller | 150/52 |
| 3,473,723 | 10/1969 | Bolling, Jr. et al. | 229/117.01 |
| 4,228,918 | 10/1980 | Kellogg | 221/65 |
| 4,365,738 | 12/1982 | Densen | 229/117.01 |
| 5,040,721 | 8/1991 | Essak | 229/112 |
| 5,110,038 | 5/1992 | Pantisano | 229/103 |

FOREIGN PATENT DOCUMENTS

| | | | |
|---|---|---|---|
| 1302573 | 7/1962 | France | 229/117.05 |

*Primary Examiner*—Gary E. Elkins
*Attorney, Agent, or Firm*—E. Vassiliou

[57] ABSTRACT

A foldable box having, in addition to primary folding lines and flat segments, a number of latent score lines in a direction perpendicular to the length of the unfolded box. The latent score lines do not interfere with the formation and the normal function of the box. However, they serve to facilitate an irreversible destruction of the box, when the box is forced to be folded into a log-like structure.

15 Claims, 4 Drawing Sheets

FIG. 2
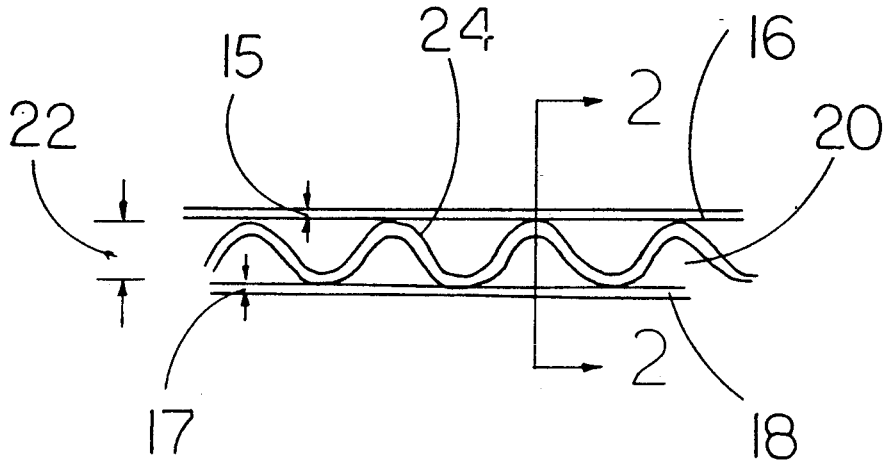
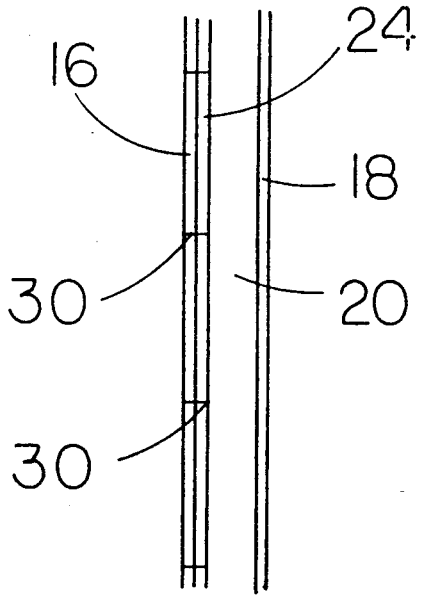
FIG. 3

DISPOSABLE BOX BY FOLDING INTO A LOG-SHAPED CONFIGURATION

1. FIELD OF THE INVENTION

This invention relates to foldable boxes, and more particularly to boxes which may be easily disposed of by destructive folding.

2. BACKGROUND OF THE INVENTION

There is a plethora of box types existing in the marketplace, such as for example those with small or large dimensions, re-usable or disposable, thin or thick, composite or single-ply structured, rigid or flexible, foldable or non-foldable, and the like.

In order to reduce cost of manufacturing, transportation, manipulation by a middle- or end-user, as well as other costs, foldable boxes are becoming increasingly popular. For the same reasons, monolithic (one piece) unfolded boxes containing primary folding lines are provided to retailers, who fold them on demand to enclose an item to be sold to the consumer.

Some of these boxes are easy to dispose of, because they may be either small, or flexible, and the like. However, there is a category of boxes, which have large and/or awkward dimensions and high rigidity, with large flat segments both before and after the box formation, which present considerable difficulty in bending and further folding for disposal. A representative type of such boxes, which are difficult to discard, are the pizza boxes. These boxes come usually in a monolithic form to the pizza-House or establishment, and they are folded around primary folding lines to form boxes having very large flat segments. These boxes are of different shapes, such as for example square, hexagonal, octagonal, and the like. The primary folding lines may be perforations, indentations, slits, cuts, or any other weakening lines, or configurations, very well known to the art of box formation. These lines provide weakening of the integrity of the unfolded box along their length, so that the unfolded box can be shaped around the weakening lines. No good way has been suggested so far by the art for utilizing folding lines on the large flat segments of the box for the purpose of future destruction of the box by folding. Therefore, there is a strong need for a mechanism on the flat segments, which does not interfere with the formation of the box or with the function of the box during its useful life, but which mechanism may be activated at will and provide means for easy destruction of the box for disposal.

U S. Pat. Nos. 2,189,436 (Rosenfield), 2,244,940 (Carruth), 2,671,593 (Page), 2,807,405 (Lambert), and 4,228,918 (Kellogg), disclose boxes which are characterized by a large multiplicity of primary fold lines which are positioned in a way to form substantially curved configurations, like for example substantially circular side wall structures.

U.S. Pat. No. 2,845,976 (Miller) discloses a collapsible roll-up container with a series of flat members each formed with a tendency to coil. The spring structure of this box, however, is expensive to make and it does not provide adequate rigidity for end-uses such as pizza boxes, and the like.

U.S. Pat. No. 5,040,721 (Essak) discloses a collapsible box with a stiffening insert.

U.S. Pat. No. 5,110,038 (Pantisano) discloses a standard corrugated pizza box which is provided with slit-cuts cut through the top panel of the pizza box in a shape to form four circular serving plates with a beveled raised edge and cross-slit cuts through the bottom panel of the pizza box separating the pizza box into four essentially equal portions for easy disposal.

None of the above references or any other reference known to Applicant discloses, mentions or suggests a foldable box as described and claimed hereinbelow.

3. SUMMARY OF THE INVENTION

The instant invention is directed to foldable boxes, and more particularly to boxes which may be easily disposed of by destructive folding. In summary, the invention pertains to a foldable box, the function of which is to contain an item, comprising:

- a first end, a second end, and a longitude having a direction from the first end toward the second end;
- an inside skin portion between the two ends;
- an outside skin portion opposite the inside skin portion;
- a middle portion comprising corrugations, the corrugations having a direction parallel to the direction of the longitude, the middle portion having a thickness and being sandwiched between the inside skin portion and the outside skin portion;
- segments which remain substantially flat in both a folded and unfolded form of the box;
- a plurality of primary folding lines serving to form the box by folding the flat segments around said primary folding lines;
- a plurality of latent score lines on at least part of the flat segments, the latent score lines originating at the inside skin portion, extending partly through the middle portion, and having a direction substantially perpendicular to the longitudinal direction of the box, the latent score lines having an effective degree of higher resistance to folding than the primary folding lines, so that they
  - present no interference with the formation and function of the box; and
  - facilitate irreversible destruction of at least some of the flat segments of the box after the function of the box has been ceased, the destruction caused by propagation of the majority of the latent score lines toward the outside skin portion of the box, when the box is folded from the first end toward the second end in a manner that the box forms a log-like structure with at least part of the inside skin portion of the box becoming an exterior of the log-like structure.

The thickness of the corrugations is preferably in the range of 0.5 to 5 mm. The latent score lines may be located at substantially equal intervals, preferably in the range of 0.5 to 5 cm. The latent score lines may also be located at increasingly wider intervals along the longitude, preferably in the range of 1 to 10 cm. Furthermore, the latent score lines may also be arranged in sets of intervals, each set having substantially equidistant intervals, the intervals increasing from set to set along the longitude. As in the previous case, the intervals between the latent score lines are preferably in the range of 1 to 10 cm. It is also possible to have latent score lines only at one end of the box, so that after initial destructive folding, a preliminary but sturdy enough log-structure has been formed to support the remainder of the destructive folding in the absence of more latent score lines. Of course, in this particular case, the sandwich structure of the box should be adequately weak to permit such an arrangement.

The latent score lines should preferably extend less than 50% through the thickness of the middle portion, more preferably less than 20%, and even more preferably less than 10%.

It is preferred that the thickness of the inside and the outside skin portions are independently in the range of 0.1 to 1 mm.

This invention is particularly applicable to boxes utilized to contain pizzas.

4. DESCRIPTION OF THE DRAWING

The reader's understanding of the present invention will be enhanced by reference to the following detailed description taken in conjunction with the drawing figures, wherein:

FIG. 1*a* is a schematic diagram showing a box in an unfolded mode, or a blank, according to a preferred embodiment of the present invention.

FIG. 1*b* is a schematic diagram showing a box in an unfolded mode, or a blank, according to a different preferred embodiment of the present invention, wherein the latent score lines are present only at one end of the box.

FIG. 2 illustrates a magnified fragmental cross-sectional elevation across line 1—1 of the embodiment illustrated in FIG. 1.

FIG. 3 is a schematic diagram showing a magnified fragmental cross sectional elevation across line 2—2 of the embodiment illustrated in FIGS. 1 and 2.

5. DETAILED DESCRIPTION OF THE INVENTION

Figure 1A:
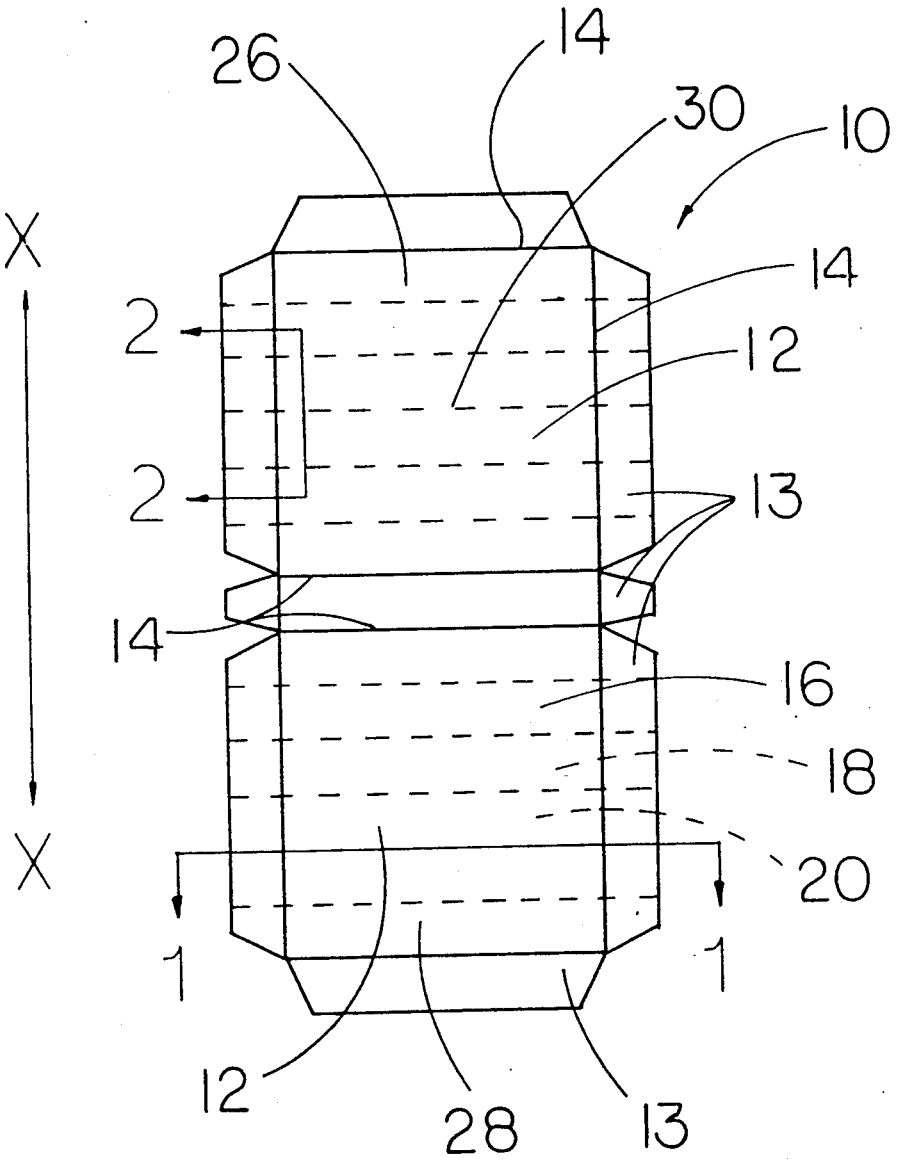
Figure 1B:
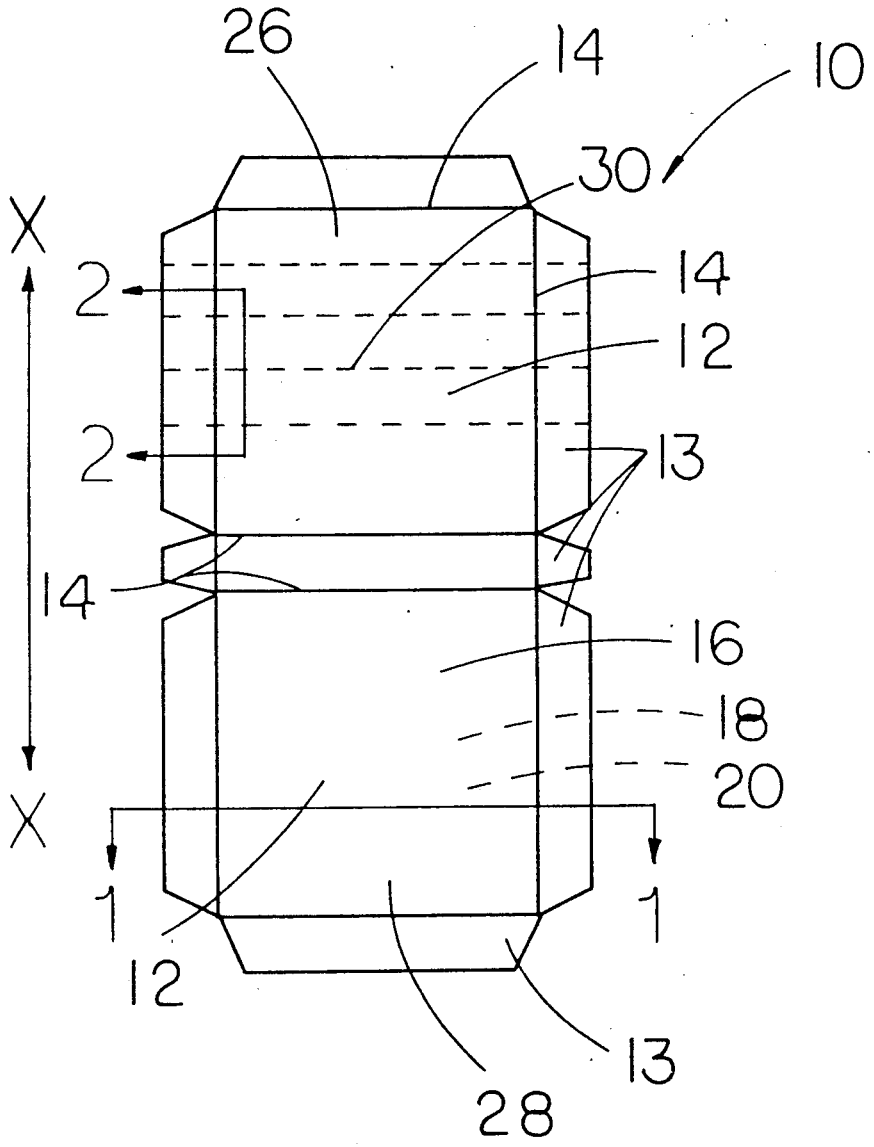

The instant invention is directed to foldable boxes, and more particularly to boxes which may be easily disposed of by destructive folding, preferably to form a log-shaped configuration.

It is important at this point to define certain terms used to describe this invention. By "foldable box" it is meant a box which takes its shape by folding different segments of a blank piece of flat material, such as cardboard for example, around folding lines, called "primary folding lines" in this discussion. This action is also called "formation" of the box. "Unfolded box" is the blank, while "folded box" is the shaped article after folding the miscellaneous segments around the "primary folding lines". The primary folding lines may include indentations, miscellaneous cuts, through-cut slits, perforations, and the like. They have a maximum possible degree of weakening the box at their location, so that an operator may perform the folding as fast and as easily as possible, with a minimum chance of misfolding the box in the wrong place. Thus, the box may be folded, unfolded, and re-folded at will many times around the "primary folding lines" without any substantial loss of its final integrity as a folded or formed box. Score lines may also be used for this purpose, mainly on the outside surface of the unfolded box or blank, so that segments of the box may be bent and folded over the length of the score lines, which then serve as "primary folding lines". However, these score lines are purposely designed to be as wide and deep as possible in order to yield to a folding or bending force, usually toward the inside of the box, as easily as possible, for the same reasons described above. According to this invention, "Latent score lines" are score lines which have higher resistance to yielding to folding or bending forces than "primary folding lines". However, once the "latent score lines have yielded, they bring about permanent destruction or damage to the integrity of the "folded" or "unfolded box" as defined above. One can control the degree of resistance to yielding to folding or bending forces by varying the width and the depth or extension of the "latent score line". The wider and the deeper the "latent score line" the more easily it will yield to folding or bending forces. Thus, it is very easy for a person of ordinary skill in the art to determine with very little experimentation a degree of resistance so that the latent score lines will not yield or present interference with the formation and the function of the box. At the same time, after the useful life or function of the box has been ceased, an operator may destructively fold the box from the first end toward the second end in a manner that the box forms a log-like structure with at least part of the inside skin portion of the box becoming an exterior of the log-like structure. The destruction mechanism is believed to be caused by propagation of the depth of the "latent score lines" through the corrugations toward the outside skin portion of the box.

Referring now to FIGS. 1*a*–3, there is depicted a foldable box 10 in an unfolded mode, according to a preferred embodiment of this invention. The box 10 has a number of segments 12, which remain substantially flat in both the unfolded and the folded form (not shown)of the box. The box has also a plurality of primary folding lines 14 serving to form the box by folding the flat segments 12 around the primary folding lines 14. The configuration of the primary folding lines 14 is shown in a simple form for purposes of simplicity. In the present state of the art, these folding lines include indentations, through-cut slits, and the like in order to form improved boxes having other than square dimensions, such as for example hexagonal, octagonal, and the like.

The box further has an inside skin portion 16, an outside skin portion 18 opposite the inside skin portion 16, and a middle portion 20 comprising corrugations 24, having a thickness 22 and being sandwiched between the inside skin portion 16 and the outside skin portion 18, as better shown in FIG. 2. It is preferred that the thicknesses 15 and 17 of the inside and the outside skin portions 16 and 18, respectively, are independently in the range of 0.1 to 1 mm, while the thickness 22 of the middle portion 20 is in the range of 0.5 to 5 mm. The corrugations 24 are substantially parallel to the longitudinal direction X—X of the box 10.

The skin and middle portions may be made of any suitable material for the construction of boxes, such as for example paper, coated paper, plastic, and the like.

The box also has a first end 26, a second end 28, and a longitude of a direction X—X (as already mentioned)-from the first end toward the second end or vice versa.

Figure 4:
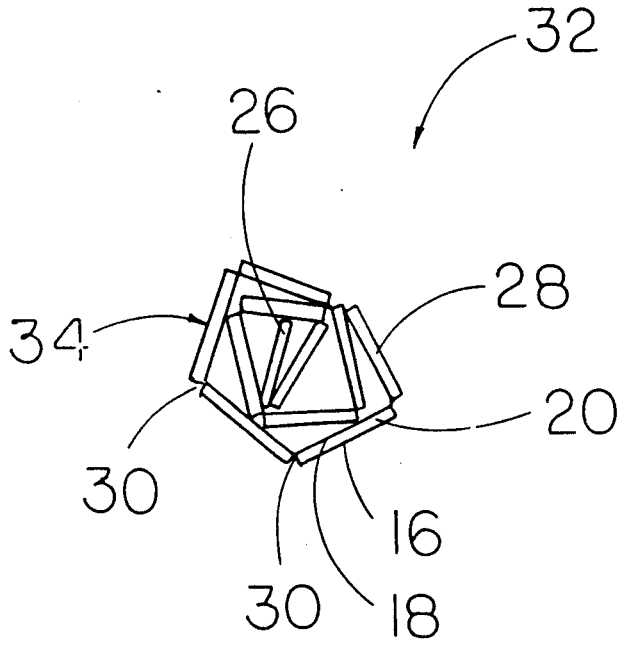
FIG. 4 is a schematic diagram showing a cross section of the box of FIG. 1, after the box has been destructively folded to form a log-like structure.

An essential feature of this invention is the presence of a plurality of latent score lines 30 on at least a part of the flat segments 12. The latent score lines 30 originate at the inside skin portion 16, and extend partly through the middle portion 20. Lines 30 have a direction substantially perpendicular to the longitudinal direction X—X of the box 10. The latent score lines 30 are made to have an effective degree of higher resistance than the primary folding lines, so that they present no interference with the formation and function of the box 10. Thus, the box may be formed by folding the flat segments 12 and 13 around the folding lines 14 without disturbing or opening the latent score lines 30, and therefore without affecting the rigidity and integrity of the box 10. It is equally important, however, that the degree of resistance of the latent lines to folding is not excessive and that the latent score lines may yield when a reasonably high force is applied by an operator to fold the box from one end to the other end. In other words, after the useful life of the box has been ceased, for example after a pizza contained in the box has been consumed, the latent score lines 30 should facilitate irreversible destruction of at least some of the flat segments of the box, the destruction caused by propagation of the majority of the latent score lines 30 through the corrugations 24 and toward the outside skin portion 18 of the box 10, when the box 10 is folded from the first end 26 toward the second end 28 in a manner that the box 10 forms a log-like structure 32 as better shown in FIG. 4, with at least part of the inside skin portion 16 of the box 10 becoming an exterior 34 of the log-like structure 32. The log-like structure may be disposed of easily, it may be recycled ,or even be burned in a fire place as a fire-starter.

As aforementioned, it is important for the corrugations 24 to be substantially parallel to the longitudinal direction X—X of the box 10, and for the latent score lines 30 to be substantially perpendicular to the same direction. It is also important that the latent score lines originate on the inside portion 16 of the box and not on the outside portion 18, in order to provide proper balance of degree of resistance to folding, when compared to primary folding lines. It is further important to note that substitution of latent score lines as defined herein, with lines having the properties of primary folding lines result in unacceptable rigidity and performance of boxes.

Also, as mentioned before, the thickness 22 of the middle portion 20 which contains the corrugations 24 is preferably in the range of 0.5 to 5 mm.

The latent score lines 30 may be located at substantially equal intervals as shown in FIG. 1*a*, preferably in the range of 0.5 to 5 cm. They may also be located at increasingly wider intervals (not shown) along the longitude, preferably in the range of 1 to 10 cm, and more preferably in the range of 2 to 7 cm, to compensate for the increasing thickness of the log-like structure 32 as the folding from the first end 26 to the second end 28 is proceeding. Furthermore, the latent score lines 30 may also be arranged in sets of intervals (not shown), each set having substantially equidistant intervals, the intervals increasing from set to set along the longitude in a similar manner and for the same reason as in the previous case. In this case also, the intervals between the latent score lines are preferably in the range of 1 to 10 cm, and more preferably in the range of 2 to 7 cm. It is also possible to have latent score lines only at one end of the box, as better shown in FIG. 1 so that after initial destructive folding, a preliminary (not shown) but sturdy enough log-structure has been formed to support the remainder of the destructive folding in the absence of more latent score lines at the remainder of the box. Of course, in this particular case, the sandwich structure of the box should be adequately weak to permit such an arrangement. The corrugations, which are necessary for rigidity and many times for thermal insulation, as well as other desirable properties are difficult to fold against their orientation. The presence of latent score lines provides an outstanding solution in retaining the rigidity of the corrugations when needed during box formation and use, but it also provides effective and convenient means for destruction when also needed for disposal of the box.

The latent score lines should preferably extend less than 50% through the thickness of the middle portion 20, more preferably less than 20%, and even more preferably less than 10%. A small extension of the latent score lines beyond the inside skin portion 16 to only 1-5% of the thickness of the middle portion 20 gives satisfactory results. No exact figures may be given, since they depend on the nature of materials used for the construction of the different portions of the box.

It is preferred that the thickness of the inside and the outside skin portions are independently in the range of 0.1 to 1 mm.

This invention is particularly applicable to boxes utilized to contain pizzas, or boxes of similar dimensions, since the top/bottom flat segments 12 are very large as compared to the side flat segments 13, and they are required to be sturdy.

In operation, the blank or unfolded box 10, as exemplified in FIG. 1*a*, is formed by folding inward the flat side-segments 13 around primary folding lines 14. In sequence, an item (not shown) is placed on one of the top/bottom flat segments 12, followed by closing the box by folding the remaining top/bottom flat segment 12, around the respective primary folding lines 14, on top of the item. Since the latent score lines possess an adequately higher degree of folding or bending as compared to the primary folding lines, they remain intact during these steps. Also, the latent score lines remain intact during handling, transferring, etc., the box with the enclosed item. At a later time, the box is opened by unfolding the box at least partially, in a reverse sequence from the one described above, so that the item is removed and used, for consumption for example, if it is a pizza for example. In order to discard the box, the box is completely unfolded in a mode as the one depicted in FIG. 1*a*. Starting at the first end 26, the box is then folded, using higher force of folding than the one required for the formation of the box, in a manner that the inside portion 16 remains on the outside of the folding. Due to the higher folding or bending forces applied, the latent score lines 30 start yielding and they propagate through the thickness 22 of the inside portion 20 which contains the corrugations 24, toward the outside portion 18, thus facilitating the folding and providing an orderly bending with substantially straight destructive scores as better illustrated in FIG. 4. This type of destructive folding is continued until a final log-like structure 32, ready for disposal is formed.

The severity of the problem that this invention solves is highest when the foldable box is monolithic. However this invention also applies to boxes comprising more than one pieces.

It should be understood that examples demonstrating the construction, features, and operation of the instant invention have been given for illustration purposes only, and should not be construed as restricting the scope or limits of this invention in any way.

What is claimed is:

1. A foldable box comprising:

a first end, a second end, and a longitude having a direction from the first end toward the second end;

an inside skin portion between the two ends;

an outside skin portion opposite the inside skin portion;

a middle portion comprising corrugations, the corrugations having a direction parallel to the direction of the longitude, the middle portion having a thickness and being sandwiched between the inside skin portion and the outside skin portion;

segments which remain substantially flat in both a folded and unfolded form of the box;

a plurality of primary folding lines serving to form the box by folding the flat segments around said primary folding lines;

a plurality of latent score lines on at least a part of the flat segments, the latent score lines origination at the inside skin portion, extending partly through the middle portion, and having a direction substantially perpendicular to the longitudinal direction of the box, the latent score lines having an effective degree of higher resistance to folding than the primary folding lines, so that they present no interference with the formation and function of the box; and facilitate irreversible destruction of at least some of the flat segments of the box after the function of the box has been ceased, the destruction being caused by propagation of the majority of the latent score lines toward the outside skin portion of the box, when the box is folded from the first end toward the second end in a manner that the box forms a log-like structure with at least part of the inside skin portion of the box becoming an exterior of the log-like structure.

2. A box as defined in claim 1, wherein the latent score lines exist only at one of said ends of the box.

3. A box as defined in claim 1, wherein the thickness of the corrugations is in the range of 0.5 to 5 mm.

4. A box as defined in claim 1, wherein the latent score lines are located at substantially equal intervals.

5. A box as defined in claim 4, wherein the intervals between the latent score lines are in the range of 1 to 5 cm.

6. A box as defined in claim 1, wherein the latent score lines are located at increasingly wider intervals along the longitude of the box.

7. A box as defined in claim 6, wherein the intervals between the latent score lines are in the range of 1 to 10 cm.

8. A box as defined in claim 6, wherein the latent score lines are in sets of intervals, each set having substantially equidistant intervals, the intervals increasing from set to set along the longitude of the box.

9. A box as defined in claim 8, wherein the intervals between the latent score lines are in the range of 1 to 10 cm.

10. A box as defined in claim 1, wherein the latent score lines extend less than 50% through the thickness of the middle portion.

11. A box as defined in claim 10, wherein the latent score lines extend less than 20% through the thickness of the middle portion.

12. A box as defined in claim 11, wherein the latent score lines extend less than 10% through the thickness of the middle portion.

13. A box as defined in claim 1, wherein the thickness of the inside and the outside skin portions are independently in the range of 0.1 to 1 mm.

14. An assembly of a foldable box and an item contained within the foldable box, the foldable box comprising:

a first end, a second end, and a longitude having a direction from the first end toward the second end;

an inside skin portion between the two ends;

an outside skin portion opposite the inside skin portion;

a middle portion comprising corrugations, the corrugations having a direction parallel to the direction of the longitude, the middle portion having a thickness and being sandwiched between the inside skin portion and the outside skin portion;

segments which remain substantially flat in both a folded and unfolded form of the box;

a plurality of primary folding lines serving to form the box by folding the flat segments around said primary folding lines;

a plurality of latent score lines on at least a part of the flat segments, the latent score lines originating at the inside skin portion, extending partly through the middle portion, and having a direction substantially perpendicular to the longitudinal direction of the box, the latent score lines having an effective degree of higher resistance to folding than the primary folding lines, so that they present no interference with the formation and function of the box; and facilitate irreversible destruction of at least some of the flat segments of the box after the function of the box has been ceased, the destruction being caused by propagation of the majority of the latent score lines toward the outside skin portion of the box, when the box is folded from the first end toward the second end in a manner that the box forms a log-like structure with at least part of the inside skin portion of the box becoming an exterior of the log-like structure.

15. A box as defined in claim 14, wherein the item contained in the foldable box is a pizza.

* * * * *